US006309235B1

(12) United States Patent
Argaut

(10) Patent No.: US 6,309,235 B1
(45) Date of Patent: Oct. 30, 2001

(54) FLUID-INSULATED ELECTRICAL LINK DEVICE

(75) Inventor: Pierre Argaut, Hericy (FR)

(73) Assignee: Sagem SA, Paris (FR)

( * ) Notice: Subject to any disclaimer, the term of this patent is extended or adjusted under 35 U.S.C. 154(b) by 0 days.

(21) Appl. No.: 09/485,290

(22) PCT Filed: Aug. 11, 1998

(86) PCT No.: PCT/FR98/01792

§ 371 Date: Feb. 8, 2000

§ 102(e) Date: Feb. 8, 2000

(87) PCT Pub. No.: WO99/09614

PCT Pub. Date: Feb. 25, 1999

(30) Foreign Application Priority Data

Aug. 13, 1997 (FR) ..... 97 10336

(51) Int. Cl.[7] ..... H01R 4/60
(52) U.S. Cl. ..... 439/199; 439/201
(58) Field of Search ..... 439/199, 200, 439/201, 202; 174/18, 21, 77, 93, 76

(56) References Cited

U.S. PATENT DOCUMENTS 3,324,449 * 6/1967 McLoad ..... 339/117
3,643,207 * 2/1972 Cairns ..... 339/96
4,054,351 * 10/1977 Gallay et al. ..... 339/117
4,085,993 * 4/1978 Cairns ..... 339/94
4,192,569 * 3/1980 Mucci ..... 339/96
4,425,017 * 1/1984 Chan ..... 339/96
5,188,538 * 2/1993 Joveux-Boullion et al. ..... 439/271
5,558,532 * 9/1996 Hopper ..... 439/310

FOREIGN PATENT DOCUMENTS 3210225 9/1983 (DE) .
0148394 7/1985 (EP) .

* cited by examiner

*Primary Examiner*—Gary Paumen
*Assistant Examiner*—Alexander Gilman

(57) ABSTRACT

The electrical link device comprises an enclosure (1, 9) containing a fluid insulator (2), a conductive link bar (3) disposed inside the enclosure and having one end fixed in leakproof manner to an insulating elastomer sleeve (12) that passes through the wall of the enclosure in leakproof manner, the link bar (3) being connected inside the enclosure to a pluggable connection member (6) surrounded by a conductive screen (15), the elastomer sleeve (12) also including a conductive deflector (16) flush with the inside surface of the insulating sleeve at a distance from the conductive screen (15).

8 Claims, 2 Drawing Sheets

FLUID-INSULATED ELECTRICAL LINK DEVICE

The present invention relates to a fluid-insulated electrical link device enabling a high voltage electricity cable to be connected to a metal-clad unit or to an outdoor unit.

BACKGROUND OF THE INVENTION

Document EP-A-148 394 discloses an electrical link device for a metal-clad unit, where the device is insulated by means of a fluid such as sulfur hexafluoride in gaseous form. The electrical link device described in that document has a conductive link bar placed inside the enclosure with one end fixed in leakproof manner to a sleeve of insulating resin that passes in leakproof manner through the wall of the enclosure that contains the insulating gas. The link bar extends outside the enclosure and is connected to a pluggable connection member disposed in the portion of the sleeve that extends outside the enclosure and that is surrounded by a conductive screen forming a Faraday cage around the pluggable connection member.

Such an electrical link device is the seat of high levels of electric stress when it is used at very high voltage. In addition, since that device does not have any electric field-distributing member, it is necessary to provide a separate stress-reducing member which is mounted on the electricity cable prior to it being put into position, thus requiring manipulation to be performed to avoid electric stresses appearing at the interface between the inside surface of the insulating sleeve and the field-distributing member, which manipulations are difficult to perform on site.

OBJECT AND SUMMARY OF THE INVENTION

The invention proposes a fluid-insulated electrical link device comprising an enclosure containing a fluid insulator, and a conductive link bar disposed inside the enclosure and having one end fixed in leakproof manner to an insulating sleeve passing in leakproof manner through a wall of the enclosure, the link bar being connected to a pluggable connection member surrounded by a conductive screen forming a Faraday cage around the pluggable connection member, wherein the pluggable connection member is disposed inside the enclosure, and the insulating sleeve is made of elastomer material and includes a conductive deflector flush with the inside surface of the insulating sleeve and at a distance from the conductive screen surrounding the pluggable connection member.

The pluggable connection member is thus surrounded by the insulating fluid contained inside the enclosure, thereby minimizing the electric stresses in the material surrounding the pluggable connection member. In addition, the device of the invention can be fully assembled and filled with fluid in a workshop such that when an electricity cable is put into place on site, all that needs to be done is to prepare the end of the cable and engage it in the insulating sleeve so as to plug the cable conductor without any leakage from the enclosure, thus making it possible to avoid handling the fluid on site.

In addition, the insulating sleeve of elastomer is pressed closely against the outside surface of the cable because of its own elasticity and because of the pressure of the insulating fluid surrounding it, thereby minimizing the risk of faults occurring at the interface between the cable and the insulating sleeve. The deflector integrated in the insulating sleeve then performs to the full its function as an electric field distributor inside the insulating sleeve.

In an advantageous version of the invention, the deflector extends on both sides of the wall of the enclosure through which the insulating sleeve passes. This minimizes the size of the link device of the invention without harming electric field distribution.

BRIEF DESCRIPTION OF THE DRAWINGS

Other characteristics and advantages of the invention will appear on reading the following description of two particular and non-limiting embodiments of the invention described with reference to the accompanying figures, in which.

MORE DETAILED DESCRIPTION

Figure 1:
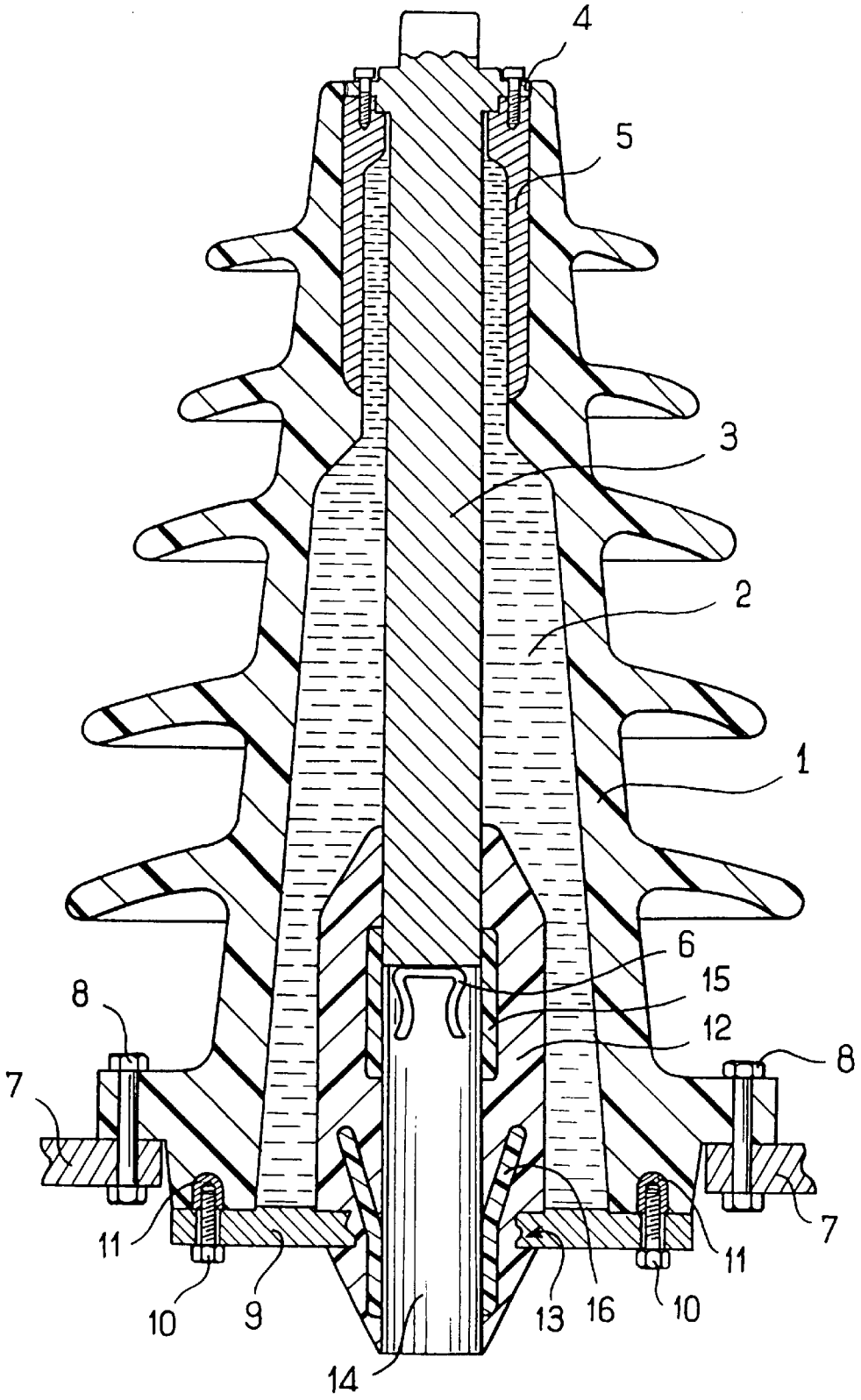
FIG. 1 is a diagrammatic axial section view of the electrical link device of the invention.

With reference to FIG. 1, the electrical link device of the invention is described in the context of an outdoor unit type device, i.e. the enclosure is constituted in part by an insulator 1, e.g. an insulator made of porcelain or of fiberglass-reinforced epoxy resin, and having outwardly-projecting skirts or "sheds". At its bottom end, the insulator 1 is fixed in conventional manner on a support 7 by bolts 8, and is closed by a metal plate 9 which is fixed by means of screws 10 that co-operate with inserts 11 embedded in the wall of the enclosure. Sealing between the plate 9 and the side wall of the insulator is preferably ensured by an O-ring (not shown).

A metal link bar 3 extends inside the enclosure and is fixed in leakproof manner thereto. To this end, the conductive link bar 3 has a collar 4 which is fixed by means of screws to a metal insert 5 that is embedded in the wall of the insulator. Preferably, an O-ring (not shown) is disposed between the collar 4 and the metal insert 5. At its bottom end, the link bar 3 carries a pluggable connection member 6 which is represented diagrammatically as being in the form of a lyre-shaped clip.

The wall 9 of the enclosure has a sleeve 12 of elastomer material passing therethrough, e.g. a sleeve made of silicone or of EPDM, the bottom end thereof being received in leakproof manner in an opening 13 through the plate 9. At its top end, the elastomer sleeve 12 is mounted in leakproof manner on the bottom end of the link bar 3, e.g. by the link bar 3 being engaged as a force-fit in the central duct 14 of the elastomer sleeve 12.

The enclosure is filled with an insulating fluid 2 such as a gas, in particular sulfur hexafluoride, an oil, or even a grease.

In register with the connection member 6, the elastomer sleeve 12 includes a conductive screen 15 which surrounds the connection member. The conductive screen 15 is made, for example, out of elastomer that is made to be conductive by means of carbon black. At its bottom end, the elastomer sleeve 12 has a deflector 16 which extends on both sides of the bottom wall 9 of the enclosure at a distance from the conductive screen 15, with the bottom portion of the deflector 16 being flush with the inside surface of the elastomer sleeve 12.

When an electricity cable is connected, it is initially prepared in conventional manner by a staircase of cuts that reveal in order starting from the end: the conductor of the cable; the insulation of the cable; and the shielding screen of the cable. The end of the cable is then inserted into the duct 14 of the elastomer sleeve 12 until the conductor of the cable is plugged in the pluggable connection member 6. The end of the cable insulation is then in register with the conductive screen 15 and the inside surface of the duct 14 is pressed against the outside surface of the cable insulation, while the deflector portion 16 which is flush with the inside surface of the elastomer sleeve 12 is in contact with the screen of the cable. To ensure that contact between the inside surface of the elastomer sleeve 12 and the various components of the cable is intimate, the cable is preferably engaged as a force-fit, or else the sleeve 12 is maintained in a slightly expanded state by a removable tube which is engaged in the workshop inside the duct 14 and which is removed after the cable has been put into place.

Figure 2:
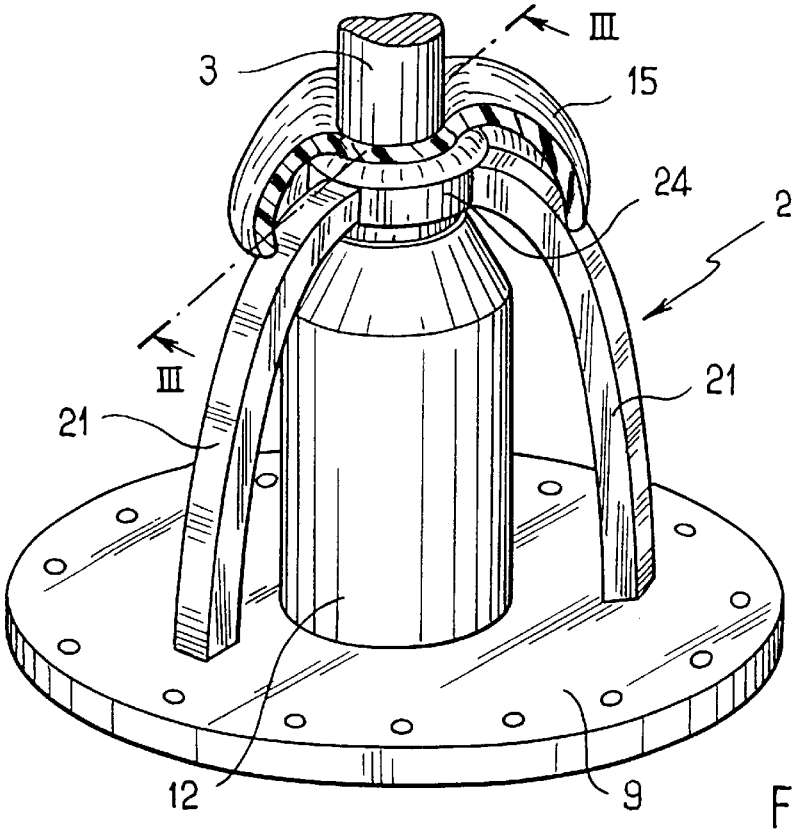
FIG. 2 is a cutaway fragmentary perspective view of another embodiment of the invention.
Figure 3:
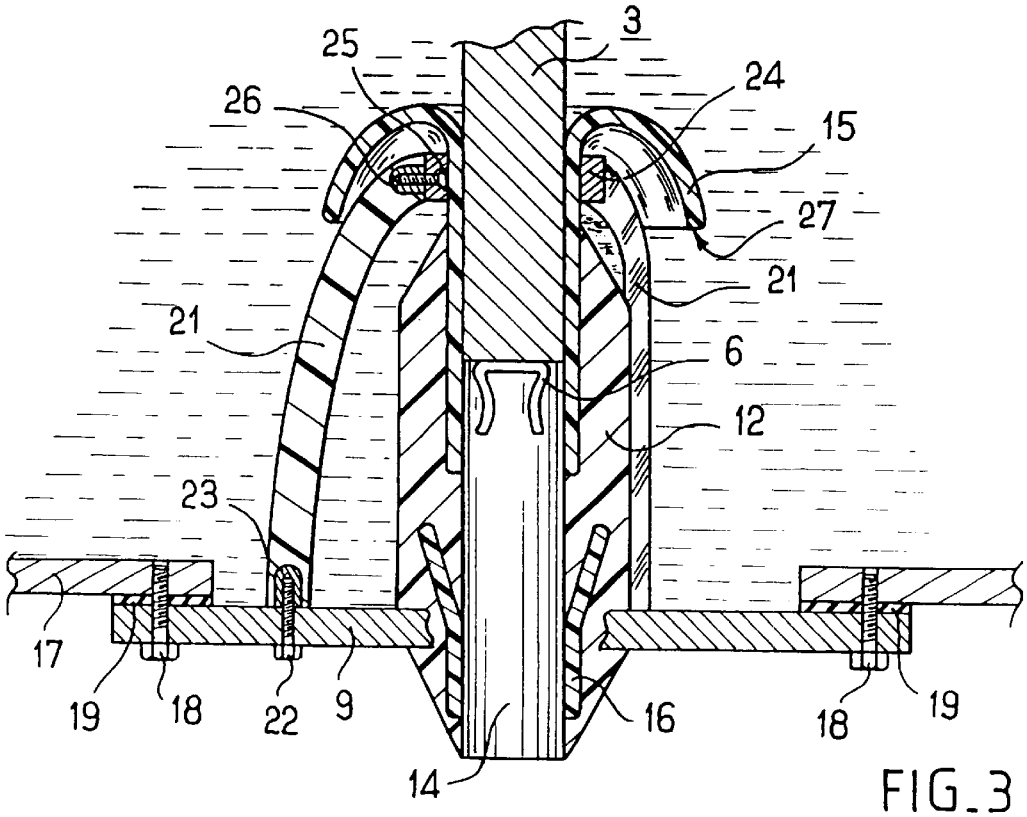
FIG. 3 is a section view on line III—III of FIG. 2.

FIGS. 2 and 3 show another embodiment of the invention which is intended more particularly for a metal-clad unit, but which can also be used in an outdoor unit of the type shown in FIG. 1. In the example shown, the enclosure containing the insulating fluid is defined by the walls or by partitions inside the unit. In this embodiment, identical numerical references are used to designate those parts that are similar to parts of the first embodiment, and an insulating sleeve 12 is fixed as before on a plate 9 forming a portion of the wall of the enclosure and is mounted for this purpose in sealed manner to another wall portion 17 by means of screws 19, with sealing being provided by a gasket 19.

As in the embodiment described above, the link bar 3 is engaged in leakproof manner in the insulating sleeve 12 and has a pluggable connection member 6 at its end which is inside the sleeve 12. At its other end (not shown), the link bar 3 is fixed in conventional manner to a bus which extends inside the unit.

In order to be able to withstand any applied longitudinal or lateral mechanical forces, in particular while the electricity cable is being put into place or in the event of a short circuit on the line, the device in this embodiment has insulating reinforcement given overall reference 20 which extends around the insulating sleeve 20. The reinforcement 20 has one end fixed to the plate 9 and an opposite end supporting the link bar 3.

In the embodiment shown, the reinforcement 20 has three insulating branches 21 shaped like flying buttresses and disposed at 120° intervals from one another around the axis of the sleeve 12. One end of each branch 21 is fixed to the plate 9 by a screw 22 engaged in an insert 23 which is embedded in the resin forming the branch 21. The other end of each branch 21 is fixed to a metal support ring 24 by a screw 25 engaged in an insert 26 embedded in the branch 21. The support ring 24 surrounds the link bar 3.

To avoid the metal ring 24 generating electric stress when the link rod 3 has voltage applied thereto, the conductive screen 15 which extends around the pluggable connection member is extended outside the insulating sleeve 12 and extends at least as far as the support ring 24. The conductive screen 15 preferably has a rounded edge 27 and is folded over the reinforcement as shown in the figures so as to surround the support ring 24 and the metal parts 26 that are associated therewith.

Naturally, the invention is not limited to the embodiments described and variants can be applied thereto without going beyond the ambit of the invention as described by the claims. The device of the invention can also be adapted to the application for which it is intended.

In particular, when the device is intended for mounting on a metal-clad unit, omitting the insulator 1 makes it possible to reduce the size of the electrical link device to a considerable extent, and consequently to decrease the overall size of the metal-clad unit in corresponding manner.

Although the invention is described with reference to embodiments in which the pluggable connection member 6 is fixed to the bottom end of the link bar 3, it is possible to implement a cavity in said link bar and fix the pluggable connection member at the end of the cavity. The side wall of the cavity then acts as the conductive screen 15 which can be made smaller. This serves to further reduce the overall size of the link device of the invention. Although the pluggable connection member 6 is shown as being in the form of a female member, it is also possible to provide a male connection member in association with the link rod 3 and to provide a female connection member on the cable.

It is also possible, inside the sleeve 12, to provide a layer of high-permittivity material extending between the deflector 16 and the conductive screen 15 so as to distributed the electric field uniformly.

Although the conductive screen 15 is shown as being flush with the inside surface of the insulating sleeve 12, it could equally well be embedded in the thickness thereof.

Although the reinforcement 20 is shown as being in the form of three branches united by a support ring, it is possible to provide a greater number of branches, or to provide a reinforcement that is tubular, cylindrical, or conical in shape, completely surrounding the elastomer sleeve and having an inside face which can be in contact with the elastomer sleeve 12. Under such circumstances, the reinforcement can even be used as a mold for the elastomer sleeve 12.

What is claimed is:

1. A fluid-insulated electrical link device comprising an enclosure (1, 9; 17, 9) containing a fluid insulator (2), and a conductive link bar (3) disposed inside the enclosure and having one end fixed in leakproof manner to an insulating sleeve (12) passing in leakproof manner through a wall (9) of the enclosure, the link bar (3) being connected to a pluggable connection member (6) surrounded by a conductive screen (15) forming a Faraday cage around the pluggable connection member, wherein AG the pluggable connection member (6) is disposed inside the enclosure (1), and wherein the insulating sleeve (12) is made of elastomer material and includes a conductive deflector (16) flush with the inside surface of the insulating sleeve and at a distance from the conductive screen (15) surrounding the pluggable connection member.

2. An electrical link device according to claim 1, wherein the deflector (16) extends on both sides of the wall (9) of the enclosure through which the insulating sleeve (12) passes.

3. An electrical link device according to claim 1, including insulating reinforcement (20) extending around the insulating sleeve (12) and having one end fixed to the wall (9) of the enclosure and an opposite end supporting the link bar (3).

4. An electrical link device according to claim 3, wherein the reinforcement (20) comprises a series of insulating arms (21) interconnected by a support ring (24) surrounding the link bar (3).

5. An electrical link device according to claim 4, wherein the support ring (24) is made of metal and in that the conductive screen (20) extends at least as far as the support ring.

6. An electrical link device according to claim 5, wherein the conductive screen (15) is folded over the reinforcement (20) so as to envelop the support ring (24) and the metal parts (26) associated therewith.

7. An electrical link device according to claim 6, wherein the conductive screen (15) has a rounded edge (27).

8. An electrical link device according to claim 3, wherein the reinforcement is tubular.

* * * * *